US008376821B2

(12) United States Patent
Nufer

(10) Patent No.: US 8,376,821 B2
(45) Date of Patent: Feb. 19, 2013

(54) WORK CABINET WITH A PRINTER ARRANGED OUTSIDE THE CABINET

(75) Inventor: Bruno Nufer, Illanu (CH)

(73) Assignee: Mettler-Toledo AG, Greifensee (CH)

( * ) Notice: Subject to any disclaimer, the term of this patent is extended or adjusted under 35 U.S.C. 154(b) by 1031 days.

(21) Appl. No.: 12/351,224

(22) Filed: Jan. 9, 2009

(65) Prior Publication Data

US 2009/0180846 A1 Jul. 16, 2009

(30) Foreign Application Priority Data

Jan. 10, 2008 (EP) ..... 08100332

(51) Int. Cl.
*B01L 1/04* (2006.01)
*B08B 15/02* (2006.01)

(52) U.S. Cl. ..... 454/187; 454/56

(58) Field of Classification Search ..... 454/59, 454/61, 62, 187, 191, 193, 56, 195
See application file for complete search history.

(56) References Cited

U.S. PATENT DOCUMENTS 3,410,619 A * 11/1968 Delnay et al. ..... 312/1
3,713,785 A 1/1973 Moran
3,976,459 A * 8/1976 Ames ..... 62/266
4,934,256 A * 6/1990 Moss et al. ..... 454/61
5,257,957 A * 11/1993 Diccianni et al. ..... 454/57
5,316,560 A * 5/1994 Krone-Schmidt et al. ... 55/385.2
5,464,475 A * 11/1995 Sikes et al. ..... 118/719
5,716,267 A * 2/1998 Hambleton et al. ..... 454/56
6,632,260 B1 * 10/2003 Siemers et al. ..... 55/385.2
6,660,054 B2 * 12/2003 Manna et al. ..... 55/385.2
6,840,594 B2 * 1/2005 Hirasawa et al. ..... 347/1
6,960,126 B2 11/2005 Desai
7,381,127 B2 * 6/2008 Price ..... 454/56
7,393,373 B1 * 7/2008 Krippner et al. ..... 55/385.2
7,717,774 B2 * 5/2010 Rothbauer et al. ..... 454/187
7,732,720 B2 * 6/2010 Olesen et al. ..... 177/180
7,980,927 B2 * 7/2011 Price ..... 454/49
8,012,228 B2 * 9/2011 Polsky ..... 55/385.2

FOREIGN PATENT DOCUMENTS

DE 3617965 A1 1/1987
EP 2123565 A1 * 11/2009
JP 2001260480 A * 9/2001
JP 2010113095 A * 5/2010
WO 2006125955 A1 11/2006

* cited by examiner

*Primary Examiner* — Steven B McAllister
*Assistant Examiner* — Frances H Kamps
(74) *Attorney, Agent, or Firm* — Standley Law Group LLP

(57) ABSTRACT

A work cabinet with a work chamber that contains, on a temporary basis, a material being worked upon has a transfer opening connecting the work chamber with an ambient space of the cabinet. The transfer opening permits access to the worked material and gives access to the work chamber. A connected ventilating device provides a lower-than-ambient pressure in the work chamber. The work cabinet further has a printer transfer opening for connecting the work chamber to the delivery outlet for the printed output of a printer that is set up in the vicinity of the work cabinet. The delivery outlet for the printer output may reach through the printer transfer opening into the work chamber or it may merely adjoin the printer transfer opening.

16 Claims, 4 Drawing Sheets

WORK CABINET WITH A PRINTER ARRANGED OUTSIDE THE CABINET

CROSS-REFERENCE TO RELATED APPLICATIONS

This application is entitled to, and claims, a benefit of a right of priority under 35 USC §119 from European patent application 08 10 0332.9, filed on 10 Jan. 2008, the content of which is incorporated by reference as if fully recited herein.

TECHNICAL FIELD

The invention relates to a work cabinet which is for example part of a clean room, part of a safety workbench, part of an insulation chamber, or part of a fume hood compartment.

BACKGROUND OF THE ART

Clean rooms, safety workbenches, insulation chambers and fume hood compartments are used in many areas of industry and higher education, such as in research and development, in manufacturing and in quality control of products. All of these arrangements include a work cabinet with a work chamber. All have further in common that the person working with them is located outside the work chamber and thus in the vicinity of the work cabinet. The work chamber is further connected to a ventilation device and has transfer openings which connect the work chamber to the outside environment of the work cabinet. These transfer openings allow the materials being worked upon therein to be brought in and to be taken out. In addition, they also make it possible to reach into the work chamber. Transfer openings can be designed as freely accessible openings, as air locks, or as openings that are equipped with protective devices, for example, with rubber gloves.

Depending on the area of application for these devices, the ventilation device generates a below-ambient or above-ambient pressure level in the work chamber.

An above-ambient pressure is generated in the work chamber in all cases where the material being worked upon must not be contaminated under any circumstances. However, this requires that the material being worked upon creates no harmful effect in the surrounding area.

A below-ambient pressure is always generated in cases where the person outside the work cabinet needs to be protected from the substances inside the work chamber. As a result of the permanent under-pressure in the work chamber, air is continuously drawn from the ambient space into the work chamber through the transfer openings. In this way, one can prevent that toxic substances escape from the work chamber into the environment.

A setup of this kind is described for example in DE 3617965 A1. The device, which is referred to as a fume cupboard, includes a work table with a work cabinet. The work cabinet is formed by the work table surface, the right and left side walls, the rear wall, and the ceiling of the fume cupboard, as well as a transparent front wall. The work chamber, being thus completely enclosed, is accessible from the front side through a transfer opening.

In these work chambers, the material being worked upon is normally measured out in doses, transferred from one container to another, mixed, heated or cooled, and in some cases dissolved, for example adding substances in powder form to a solvent. In these processes, one needs to ensure when different substances are being treated that no mix-up or mislabeling can occur. Marking the individual containers correctly also includes that the exact fill quantity of the material being worked upon or substance is noted. The containers are normally marked by hand.

A variety of dosage-dispensing devices have been available for years, providing the capability to automatically dispense measured quantities of, e.g., a pulverous substance. The weight of the measured-out quantity is registered by means of a weighing cell. To mark the container, the weighing result can therefore be printed out on a printer together with an identifier means, for example a barcode or a matrix code. The carrier of the imprint is in most cases a self-adhesive label which can then be affixed to the container in addition to the hand-written information.

The foregoing procedure has the disadvantage that even when using all due diligence it is possible that a wrong label is affixed to one of the manually marked containers. Furthermore, the hand-marking takes a certain amount of time, which unnecessarily lengthens the entire dosage-dispensing process and therefore exposes the person involved in the activity, for example dealing with toxic or carcinogenic substances, to a high level of mental stress for an unnecessarily long time. In addition, the procedure which has just been described and which conforms to the safety regulations is sometimes disregarded by the operators in the sense that after each dispensing process, the workers will fetch the label from the printer outside of the cabinet into the work chamber without following the instructions for cleaning their hands.

It is therefore the object of the present invention to ensure that containers which have been filled with material being worked upon inside a work chamber are labeled quickly and safely with the output products of a printer. Furthermore, the laborious marking by hand is to be eliminated.

SUMMARY

This task is solved by a work cabinet according to claim 1. Details and further developed embodiments of the invention are defined in the further claims which are dependent thereupon.

A work cabinet according to the invention with a work chamber which serves to contain material being worked upon on a temporary basis has at least one transfer opening through which the work chamber is connected to the ambient space of the work cabinet. The at least one transfer opening further serves to bring in and/or take out the material being worked upon and/or to give access to the work chamber. In addition, the work chamber is connected to a ventilating device which preferably serves to create a below-ambient pressure in the work chamber. The work cabinet further has at least one printer transfer opening whereby the work chamber is connected to the delivery outlet for the printed output of a printer that is set up in the vicinity of the work cabinet. It is irrelevant here whether the delivery outlet for the printer output reaches through the printer transfer opening into the interior of the work chamber or the delivery outlet for the printer output is merely adjoining the printer transfer opening. The delivery outlet for the printer output preferably includes a housing part shaped like an air duct.

The setup according to the invention, wherein the printer is arranged outside the cabinet but the products carrying the imprints can pass into the work chamber through the printer transfer opening, has many advantages. First of all, the danger of a mix-up which was described above can be eliminated, because after each dosage-measuring process the filled container is immediately marked with the carrier of the imprint, for example a self-adhesive label on which the fill weight, the name of the substance and an identification code have been printed. As an identification code, it is conceivable to use a bar code, a matrix code or a sequence of numbers. Of course, the carrier of the imprint can in addition contain a memory storage medium, for example an RFID tag on which the data are stored electronically.

As a second advantage, there is no more cumbersome marking by hand inside the work chamber. As this takes considerably more time than simply sticking on a label, a considerable amount of time can be saved with the arrangement according to the invention.

Third, entire series of dosage deliveries can be performed without afterwards having to sort out the labels produced by the printer in order to correlate them with the manually marked containers.

Fourth, as the printer is arranged in the vicinity of the work cabinet rather than inside the working cabinet, it is always accessible without presenting any danger. For example, the printer can be serviced without danger and refilled with ink ribbon and labels. Furthermore, malfunctions of the printer can be repaired at any time, even when an operator is working in the work chamber.

As has been described hereinabove, the work cabinet according to the invention has a ventilation device to prevent that toxic substances could contaminate the ambient environment of the work cabinet. In an advantageous further developed embodiment of the invention, the delivery outlet for the printed output therefore includes a housing part with defined intake openings through which ambient air from the outside vicinity of the work cabinet can be drawn through the printer transfer opening into the work chamber. This prevents material being worked upon from escaping through the printer transfer opening into the interior of the printer housing. The reason why this is important is that residues on the printer housing could contaminate for example the operator and the environment when replenishing the label supply in the printer. To prevent that dust and dirt from the ambient environment could penetrate into the work cabinet, the intake openings could be equipped with an air filter.

As a way to keep order in the work chamber, there is preferably a holding tray for the output of the printer arranged in the vicinity of the printer transfer opening inside the work chamber. Thus, the printed items have a defined place where they can be picked up by the operator when needed. The holding tray can further be equipped with a sensor whose signal, which indicates whether or not a label has been taken out, is transmitted for example to a monitoring device. The monitoring device, for example a production planning and control system or a control and regulation device, can be programmed so that a next-following operation in the work chamber cannot be executed until the printed item has been taken out of the holding tray.

Depending on the type of printer, more or less dust and dirt can be produced in the printer housing during the printing process. This dust and dirt can get from the printer housing through the printout delivery outlet into the work chamber, for example if there are no intake openings formed in the housing part of the printout delivery outlet, or if the intake openings are too small. Further, especially with a thermal printer, a considerable amount of heat can be generated in the printer housing and can likewise get into the work chamber. Depending on the temporary placement of instruments in the work chamber, dust and dirt can spread over the entire work chamber and contaminate the material being worked upon. Furthermore, the hot air generated by the printer can affect sensitive measuring instruments, for example balances, that are set up in the work chamber.

As a way to avoid the drawbacks described above, the ventilation device in a further embodiment of the invention can include at least one suction duct with at least one intake opening arranged at its end, wherein the intake opening is arranged inside the work chamber and in the area of the printer transfer opening. With this arrangement, the hot air streaming through the printer transfer opening, which may be loaded with dust and dirt, can be suctioned off directly at the point where the printer transfer opening enters into the work chamber.

According to a further possible solution to protect the printer housing from the material being worked upon or to prevent the material being worked upon from becoming contaminated by dust and dirt, the printer transfer opening or the printout delivery outlet includes an air lock with at least two rollers pushed against each other. The duct-shaped cross-section of the printout delivery outlet is to a large extent closed off by the two rollers, with the printed items being moved forward between the two rollers which are preferably made of a flexible material.

The same objective can also be met with an arrangement where the printer transfer opening of the printout delivery outlet includes an air lock with a revolving gate.

As mentioned herein farther back, the work cabinet according to the invention does not necessarily have to be a free-standing installation. The work cabinet can also be part of a clean room, part of a safety workbench, part of an insulation chamber, or part of a fume hood compartment. The work cabinet according to the invention can furthermore also be referred to as a safety cabinet or a weighing cabinet. The transfer openings can of course be equipped with closing means, for example with doors, flaps or lids.

If the work chamber is to be used to automatically measure out doses of the material being worked upon into containers, small dosage-dispensing instruments suggest themselves which are equipped with a weighing cell to control the delivery rate. The weighing cell serves to continuously register the mass of the container, more specifically the contents of the container, during the dispensing process and to transmit the weighing signal to a processor unit. The processor unit continuously compares the weighing signal to a target value that was previously set by the operator. As soon as the weighing signal matches the target value, the dispensing process is stopped. The higher the measuring accuracy of the weighing cell, the more sensitive the weighing cell is in reacting to disturbances such as air turbulences inside the work chamber. As the work cabinet has a ventilation device for the aforementioned reasons, such air turbulences are unavoidable. It is therefore preferable to arrange a dosage-dispensing device with at least one draft shield in the work chamber. A draft shield, as the term is used herein, means a housing or a barrier that is suitable to keep the air turbulences away from the sensitive parts of the weighing cell as well as preferably from the container that is resting on a load receiver of the weighing cell.

This draft shield can in addition serve as an additional safety barrier against the escape of toxic substances. Of course, any kind of gravimetric measuring instruments, with or without draft shield can be arranged and used in the work cabinet according to the invention.

The work chamber can further have a connection for a gas supply, to which the space enclosed by the draft shield of the dosage-dispensing device can be connected. The interior space in the draft shield can thus be flooded for example with a protective gas if necessary. Furthermore, an above-ambient pressure can be generated inside the draft shield for the protection of the material being worked upon. It is possible that for example minute particles of a pulverous material being worked upon may escape into the work chamber through small leaks in the draft shield and when opening the draft shield. However, due to the below-ambient pressure in the work chamber which is caused by the ventilation device and due to the inflow of air from the environment, such particles are continuously drawn off by the ventilation device and are therefore not getting into the ambient environment.

BRIEF DESCRIPTION OF THE DRAWINGS

The work cabinet according to the invention with a printer transfer opening is explained in the following in more detail through examples and with references to the drawings, wherein.

DETAILED DESCRIPTION

Figure 1:
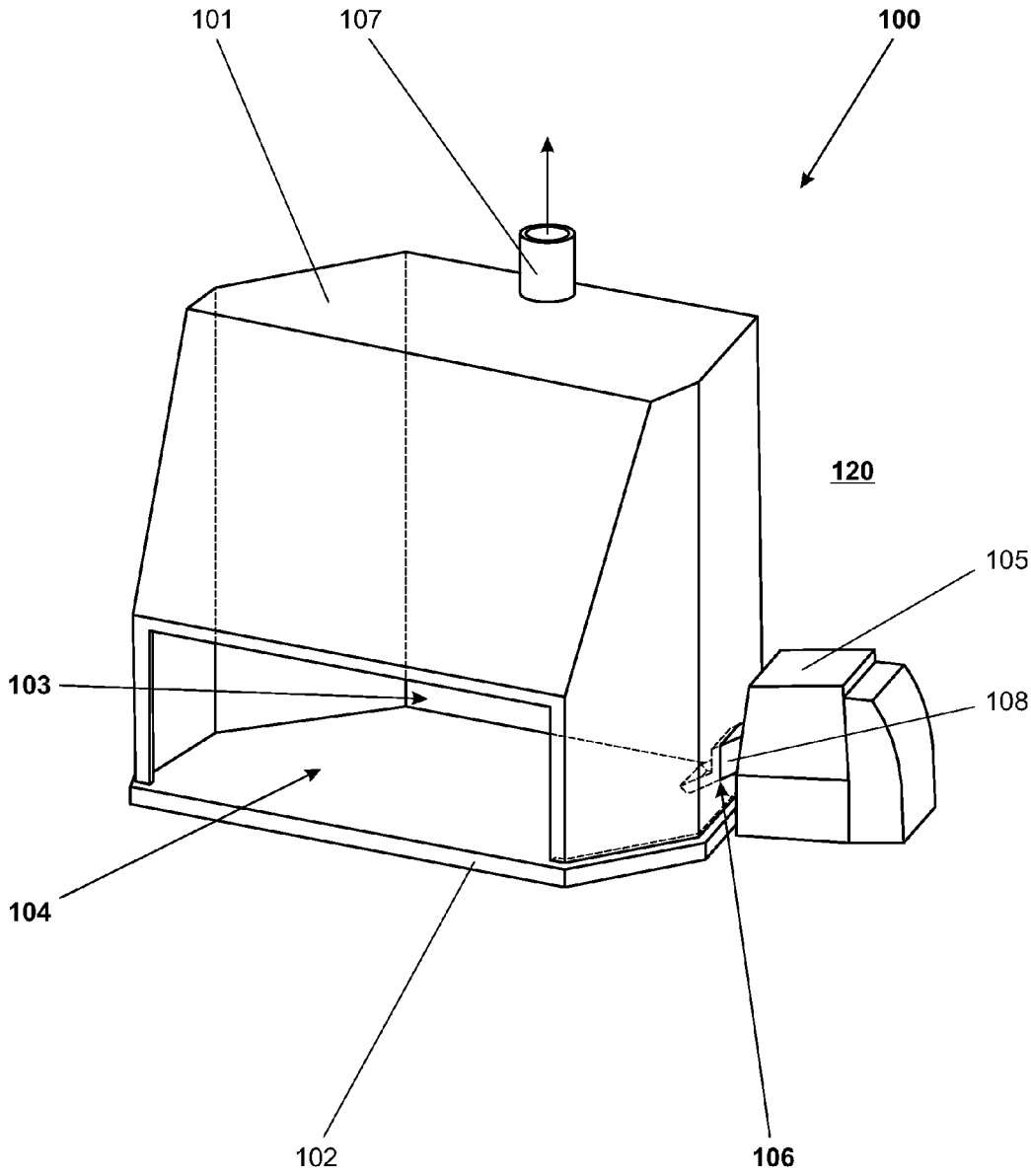
FIG. 1 shows a schematic three-dimensional representation of a work cabinet with a transfer opening arranged at the front side, a printer transfer opening arranged laterally, and a printer arranged in the vicinity of the work cabinet, wherein the delivery outlet for the printed items is connected to the printer transfer opening.

In FIG. 1, a work cabinet 100 is shown schematically in a three-dimensional view. The work cabinet 100 has a cabinet housing 101 consisting of a front wall, two side walls and a ceiling wall, and a cabinet floor 102. The cabinet housing 101 and the cabinet floor 102 enclose a work chamber 103 and thus separate this space from the ambient environment 120 of the work cabinet 100. The cabinet housing 101 is made preferably of a transparent material in order to ensure as much as possible an unobstructed view into the work chamber 103. In the front wall of the cabinet housing 101, a transfer opening 104 is formed which allows access from the outside environment 120 to the work chamber 103.

There is further a printer 105 arranged in the vicinity 120 of the work cabinet 100. The cabinet housing 101 has a printer transfer opening 106 through which a duct-shaped delivery outlet for the printouts of the printer 105 which is arranged in the vicinity 104 of the work cabinet 100 reaches into the work chamber. By way of this printer transfer opening 106, the delivery outlet 108 for the printed items is thus connected to the work chamber 103. Of course, the delivery outlet 108 can also be arranged so that it adjoins the printer transfer opening 106, in which case the printed items produced by the printer 105 leave the delivery outlet 108 at the junction to the printer transfer opening 106 and pass through the transfer opening 106 into the work chamber 103.

The work cabinet 100 further has a ventilation device 107 which is represented schematically in FIG. 1 as an exhaust pipe at the top side of the cabinet housing 101. The known state of the art offers ventilation devices of the most diverse configurations, and it is therefore considered unnecessary to give a detailed description here. The most important feature of the ventilation device 107 is that it allows a below-ambient pressure to be generated in the work chamber 103 and that as a result of the pressure difference relative to the ambient atmosphere, outside air can flow from the ambient space 120 through the transfer opening 104 and through the printer transfer opening 106 into the work chamber 103.

Of course, the delivery outlet 108 for the printed items can include intake openings which are not shown here, through which ambient air can be drawn from the outside environment 120 of the work cabinet 100 through the printer transfer opening 106 into the work chamber 103. This prevents that material being worked upon could enter by way of the printer transfer opening 106 into the interior of the printer housing. The reason why this is important is that residues on the printer housing could contaminate for example the operator and the environment. To prevent that dust and dirt from the ambient environment could get from the environment into the delivery outlet 108 and into the work cabinet 103 the intake openings could be equipped with an air filter.

Figure 2:
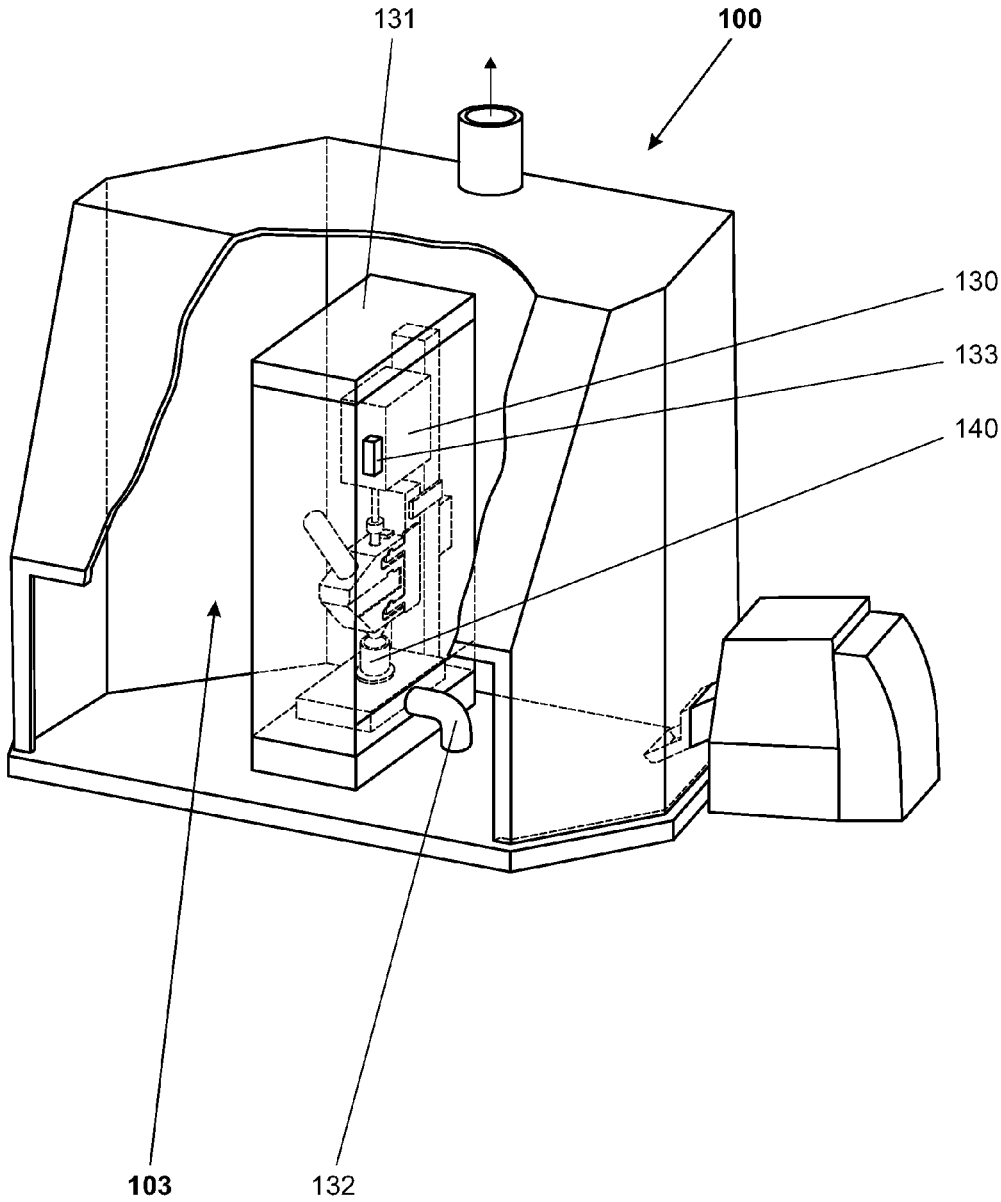
FIG. 2 shows a schematic three-dimensional representation of the work cabinet of FIG. 1, wherein a dosage-dispensing device equipped with a draft shield is arranged in the work chamber of the work cabinet.

FIG. 2 shows a schematic three-dimensional representation of the work cabinet 100 of FIG. 1, wherein a dosage-dispensing device 130 is arranged in the work chamber 103 of the work cabinet 100. Below the dispensing head of the dosage-dispensing device 130, a container 140 can be seen which is to receive the measured-out substance dose. The dosage-dispensing device 130, drawn in broken lines in FIG. 2, is enclosed by a draft shield 131 which is drawn in a schematic fashion. As indicated by the handle 133, the draft shield 131 can be opened, allowing free access to the dosage-dispensing device 130 when the draft shield 131 is opened.

Furthermore a gas connection 132 entering into the draft shield 131 is shown schematically. This gas connection 132 is of special importance in conjunction with the draft shield 131. If a contamination of the material being worked upon is to be excluded or if the material being worked upon may not under any circumstances come into contact with the ambient air, the interior space of the draft shield 131 can be flooded through the gas connection 132 with a suitable gaseous medium, for example a protective gas, prior to the dosage-dispensing process. If the protective gas is heavier than air, the container 140 stays flooded with protective gas even if the draft shield 131 is opened after the dosage-dispensing process.

Figure 3:
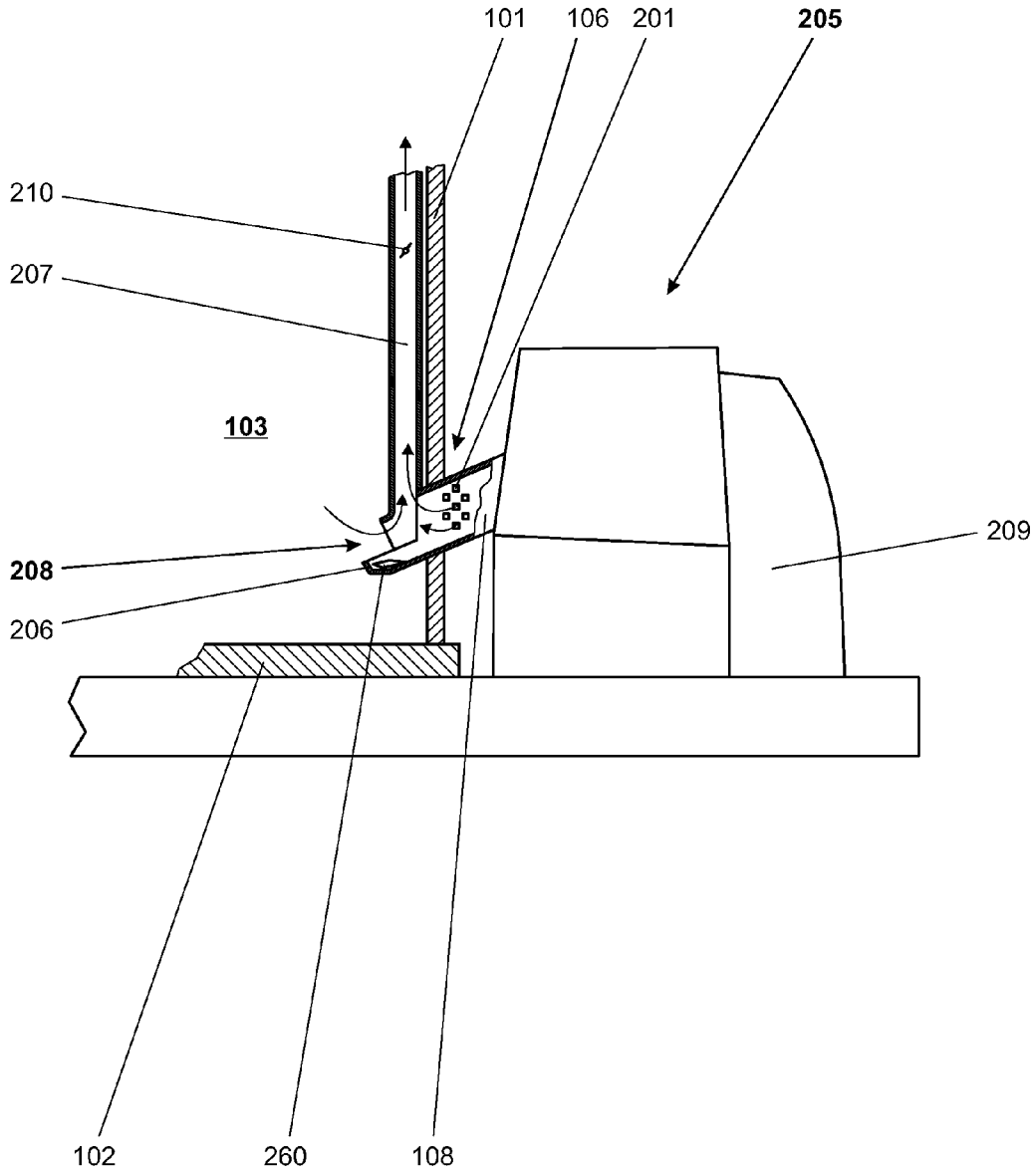
FIG. 3 in plan and sectional view schematically illustrates a detail of the work cabinet in the area of the printer transfer opening with a first design version of the delivery outlet for the printed items.

FIG. 3 in plan and sectional view schematically illustrates a detail of the work cabinet in the area of the printer transfer opening 106. The cabinet housing 101, the work chamber 103, the cabinet floor 102 and the first design version of the delivery outlet 108 for the printed items are analogous to the units shown in FIGS. 1 and 2. At the end that reaches into the work chamber 103, the delivery outlet 108 for the printed items has a holding tray 206. The items 260 printed by a printer 205, for example self-adhesive labels, slide into the holding tray 206, from which they can be picked up by the operator. As a result, there is always a label available that matches the just completed sample and is affixed to the latter immediately after printing, for example after each completed dosage-dispensing process. The holding tray 206 can for example have a sensor whose signal, indicating whether or not the printed item has been taken out, can be transmitted for example to a control- and regulation device of the dosage-dispensing device described above. The control- and regulation device can be programmed so that the next-following dosage-dispensing process can be executed only after the printed item 260 has been taken out of the holding tray 206.

Unlike the embodiments shown in FIGS. 1 and 2, an air-suction duct 207 which is connected to the ventilation device (not shown here) is arranged in the work chamber 102. An intake opening 208 of the air-suction duct 207 is arranged above the holding tray 206. By arranging the intake opening 208 in this way, air is drawn on the one hand through the tubular-shaped delivery outlet 108 for the printed items and on the other hand from the work chamber 103. The air stream in the delivery outlet 108 prevents gases and pulverous substances from escaping out of the work chamber 102 into the interior space of the printer. This arrangement further also prevents that dust and dirt, for example toner particles of the printer, could get into the work chamber 103.

In order to obtain a clearly defined air stream to flow through the delivery outlet for a given suction power of the ventilation device, the delivery outlet 108 can be equipped with suction intake openings 201 of a defined cross-sectional area. The air flow can in addition serve to support the movement of the printed items inside the delivery outlet 108. The suction intake openings 201 can further be equipped with a filter (not shown here).

In order to be able to make a fine adjustment of the air streams in the area of the delivery outlet 108 and of the holding tray 206, the air-suction duct 207 can have an adjustable air flap 210.

Figure 4:
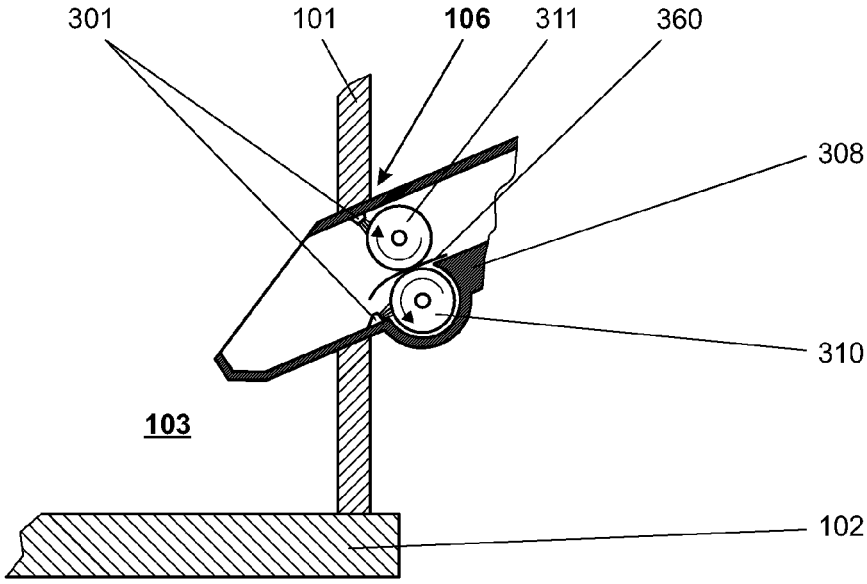
FIG. 4 in plan and sectional view schematically illustrates a detail of the work cabinet in the area of the printer transfer opening in a second design version of the delivery outlet for the printed items.

FIG. 4 likewise schematically illustrates a detail of the work cabinet in the area of the printer transfer opening 106 in plan and sectional view. The cabinet housing 101, the work chamber 103 and the cabinet floor 102 are analogous to the units shown in FIGS. 1, 2 and 3. FIG. 4, however, shows a second design version of the delivery outlet 308 for the printed items. There is an air lock arranged inside the duct-shaped delivery outlet 308. This air lock in essence includes a first roller 310 and a second roller 311. The rotary axes of the rollers 310, 311 are arranged parallel to each other in a plane that runs orthogonal to the lengthwise direction of the delivery outlet 308. The diameters of the rollers 310, 311 are selected so that the cylindrical surfaces of the rollers 310, 311 touch each other along a line. The rollers 310, 311 are made of an elastic material, so that a printed item 360 can be moved freely between the rollers 310, 311. The rollers are preferably driven by a drive mechanism (not shown here). The internal contours of the delivery outlet 308 between the printer and the rollers 310, 311 are preferably shaped so that the printed item 360 is constrained to pass between the two rollers 310, 311.

As a means to prevent the rollers 310, 311 from collecting dirt, there can be brushes 301 arranged at appropriate locations. These brushes 301 are preferably made of electrically conductive materials and connected to ground, so that electrostatic charges of the printed item 360 and/or of the rollers 310, 311 can be eliminated.

Figure 5:
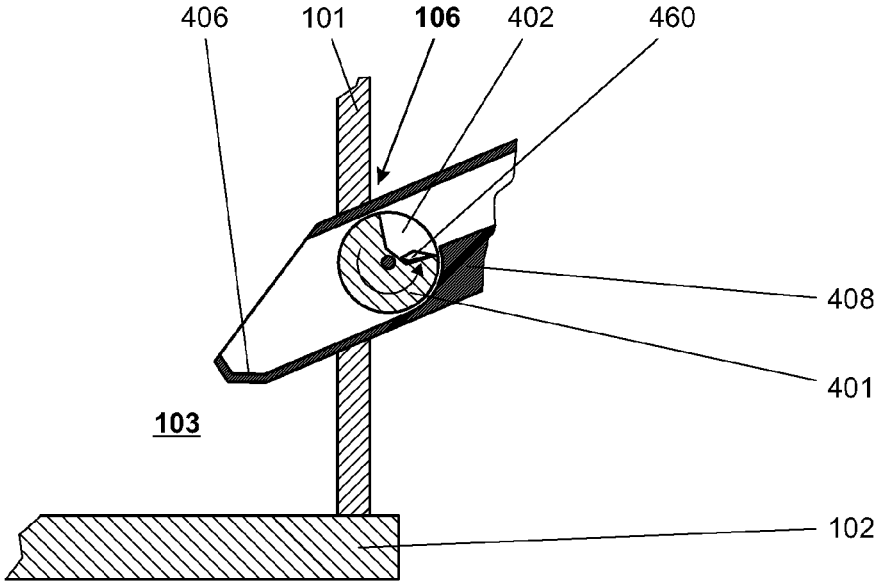
FIG. 5 in plan and sectional view schematically illustrates a detail of the work cabinet in the area of the printer transfer opening in a third design version of the delivery outlet for the printed items.

FIG. 5 likewise schematically illustrates a detail of the work cabinet in the area of the printer transfer opening 106 in plan and sectional view. The cabinet housing 101, the work chamber 103 and the cabinet floor 102 are analogous to the units shown in FIGS. 1, 2 and 3. Further illustrated is a third design version of the delivery outlet 408 for the printed items. As in FIG. 4, an air lock is arranged inside the duct-shaped delivery outlet 408. The air lock in the embodiment of FIG. 5 is formed by a revolving gate 401. The gate 401, whose rotary axis is arranged in a plane that extends orthogonal to the delivery outlet 408, has a recess 402. As soon as the printer puts out a printed item 460, the latter glides through the duct of the delivery outlet 408 into the recess 402. The slope angle of the duct of the delivery outlet 408 relative to the direction of gravity needs to be selected so that the printed item 460, pulled by gravity, glides on its own through the duct into the recess 402. Next, the revolving gate 401 is rotated by about 120° in the direction indicated by the arrow, whereby the printed item 460 is transferred to a holding tray 406. Even though the air lock reduces the cross-sectional area of the air passage of the delivery outlet 408 to a few narrow gaps, a small amount of air can still be drawn through these gaps into the work chamber 103. Of course, it is also possible to totally eliminate these gaps with a suitable design configuration, for example with labyrinth baffles and elastic sealing means.

Although the invention has been presented though specific examples of embodiments, there are obviously numerous further variations that could be created from a knowledge of the present invention, for example by combining the features of the individual embodiments with each other and/or by exchanging individual functional units of the embodiments against each other. In particular, there are further embodiments conceivable in which the subject of the invention could be incorporated, for example if the work cabinet is used as a component of a larger automated system.

What is claimed is:

1. A work cabinet, surrounded by an ambient space that contains a printer with a delivery outlet for printed output, the work cabinet defining, by separating from the ambient space, a work chamber for containing a material being worked upon, the work cabinet comprising:

a transfer opening through which the work chamber and the ambient space are connected, the transfer opening providing access to the work chamber and to the work material contained therein;

a printer transfer opening, adapted for connection to the delivery outlet of the printer, for transferring the printed output into the work chamber; and a ventilating device operatively connected to the work chamber to provide a below-ambient pressure therein.

2. The work cabinet of claim 1, further comprising:

a housing part with defined intake openings, the housing part being a part of the printer transfer opening, the defined intake openings providing a path by which air from the ambient space is drawn through the printer transfer opening into the work chamber.

3. The work cabinet of claim 2, further comprising:

a holding tray, arranged inside the work chamber in the area of the printer transfer opening, for printed output from the printer.

4. The work cabinet of claim 2, wherein:

the ventilation device comprises a suction duct, with an intake opening arranged at an end of the suction duct that is inside the work chamber and in the area of the printer transfer opening.

5. The work cabinet of claim 2, further comprising:

an air lock with at least two rollers that are pressed against each other, the air lock being a part of the printer transfer opening.

6. The work cabinet of claim 2, further comprising:

an air lock with a revolving gate, the air lock being a part of the printer transfer opening.

7. The work cabinet of claim 1, wherein:

the work cabinet is part of a clean room, part of a safety workbench, part of an insulating chamber, or part of a fume hood compartment.

8. The work cabinet of claim 2, further comprising:

arranged in the work chamber, and having a draft shield, at least one of: a dosage-dispensing device and a gravimetric measuring instrument.

9. The work cabinet of claim 8, further comprising:

a gas connection for communication with the space enclosed by the draft shield.

10. The work cabinet of claim 1, wherein:

the ventilation device comprises a suction duct, with an intake opening arranged at an end of the suction duct that is inside the work chamber and in the area of the printer opening.

11. The work cabinet of claim 1, further comprising:

an air lock with at least two rollers that are pressed against each other, the air lock being a part of the printer transfer opening.

12. The work cabinet of claim 1, further comprising:

an air lock with a revolving gate, the air lock being a part of the printer transfer opening.

13. The work cabinet of claim 1, further comprising:

arranged in the work chamber, and having a draft shield, at least one of: a dosage-dispensing device and a gravimetric measuring instrument.

14. The work cabinet of claim 13, further comprising:

a gas connection for communication with the space enclosed by the draft shield.

15. A work cabinet, surrounded by an ambient space that contains a printer with a delivery outlet for printed output, the work cabinet defining, by separating from the ambient space, a work chamber for containing a material being worked upon, the work cabinet comprising:

a transfer opening through which the work chamber and the ambient space are connected, the transfer opening providing access to the work chamber and to the work material contained therein;

a printer transfer opening, adapted for connection to the delivery outlet of the printer, for transferring the printed output into the work chamber, the printer opening further comprising a housing part with defined intake openings that provide a path by which air from the ambient space is drawn through the printer transfer opening into the work chamber;

a holding tray, arranged inside the work chamber in the area of the printer opening, for printed output from the printer;

an air lock that is a part of the printer transfer opening; and a ventilating device, comprising a suction duct, with an intake opening arranged at an end of the suction duct that is inside the work chamber and in the area of the printer opening, the ventilating duct operatively connected to the work chamber to provide a below-ambient pressure therein.

16. A work cabinet, surrounded by an ambient space that contains a printer for generating printed output, the work cabinet defining, by separating from the ambient space, a work chamber for containing a material being worked upon, the work cabinet comprising:

a transfer opening through which the work chamber and the ambient space are connected, the transfer opening providing access to the work chamber and to the work material contained therein;

a delivery outlet, adapted to receive printed output generated by the printer;

a printer transfer opening, connected to the delivery outlet, for transferring the printed output into the work chamber; and a ventilating device operatively connected to the work chamber to provide a below-ambient pressure therein.

* * * * *